United States Patent [19]

Tiedeman et al.

[11] Patent Number: 4,857,149

[45] Date of Patent: Aug. 15, 1989

[54] METHOD AND PRODUCTS FOR SIZING PAPER AND SIMILAR MATERIALS

[75] Inventors: George T. Tiedeman, Seattle; Jerome M. Gess, Bellevue, both of Wash.

[73] Assignee: Weyerhaeuser Company, Tacoma, Wash.

[21] Appl. No.: 125,787

[22] Filed: Nov. 20, 1987

Related U.S. Application Data

[63] Continuation-in-part of Ser. No. 905,016, Sep. 8, 1986, abandoned.

[51] Int. Cl.[4] ..... D21H 3/08

[52] U.S. Cl. ..... 162/158; 162/179; 162/183

[58] Field of Search ..... 162/164.6, 9, 158, 179, 162/183, 182

[56] References Cited

U.S. PATENT DOCUMENTS

| | | | |
|---|---|---|---|
| 2,601,597 | 6/1952 | Daniel et al. | 162/164.6 |
| 3,526,524 | 9/1970 | Kulick | 162/158 |
| 3,652,563 | 3/1972 | Petersen et al. | 162/158 |
| 3,726,822 | 4/1973 | von Bonin et al. | 162/158 |
| 3,900,335 | 8/1975 | Beck | 162/158 |
| 3,993,640 | 11/1976 | Pickard et al. | 162/158 |
| 4,505,775 | 3/1985 | Harding et al. | 162/9 |
| 4,576,680 | 3/1986 | Kawatani et al. | 162/158 |
| 4,627,889 | 12/1986 | Bernheim et al. | 162/158 |

FOREIGN PATENT DOCUMENTS

| | | | |
|---|---|---|---|
| 1008609 | 4/1977 | Canada . | |
| 1546338 | 6/1971 | Fed. Rep. of Germany | 162/158 |
| 45-39481 | of 1970 | Japan . | |
| 53-45403 | of 1978 | Japan . | |
| 5997 | 1/1982 | Japan | 162/164.6 |
| 1266829 | 3/1972 | United Kingdom . | |

OTHER PUBLICATIONS

Casey, *Pulp and Paper*, 3rd ed., vol. III (1981) pp. 1574–1576.

BASF—Fixing Agent FP Brochure (Jan., 1975).

Bowman, H. G. and John A. Cuculo, The Reactions of Cellulose with Amic Acids etc. *Textile Research Journal* 45: 766–772 (1975).

Lund, Richard C., Mobility and Bonding of Alkyl Ketene Dimer Sizing, Unpublished M. S. Thesis, Univ. of Washington (1983).

Marton, J. and Terezia Marton, Some New Principles to Optimize Rosin Sizing, *Proc., TAPPI Papermakers Conf.* 1982, pp. 15–24.

*Primary Examiner*—Peter Chin

[57] ABSTRACT

The invention is a method of sizing paper and, in particular, paper made under neutral to alkaline conditions at least as high as 10.5. The papermaking stock is first treated with a polycationic material to provide sizing receptive sites uniformly distributed over the fiber surface. The presence of the anchoring points is critical to the later redistribution of the sizing material in the dryer section of the paper machine. The sizing material is then added to the slurry. This is then brought down onto the fibers by addition of a small amount of a size precipitant such as alum. The sizing molecule should have a hydrophilic portion with two hetero atoms forming a bidentate analog structure. This must have a pK in water of 6.0 or higher and a vapor pressure preferably at least 0.0006 mm Hg at 60° C. The polycationic material provides anchoring/orienting sites on the fiber to which the small globules of sizing attach when the emulsion is broken by the precipitant. Sizing will develop in the dryer section of the paper machine, presumably by vapor phase redistribtution of sizing from the attached globules to unfilled sites where an anchoring point is present. Alkyl and alkenyl substituted catechols, betadiones, hydroxamic acids and imides are among the new classes of sizing materials disclosed.

4 Claims, No Drawings

METHOD AND PRODUCTS FOR SIZING PAPER AND SIMILAR MATERIALS

This application is a continuation-in-part of application Ser. No. 06/905,016, filed Sept. 8, 1986, now abandoned.

BACKGROUND OF THE INVENTION

The present invention comprises a method for sizing paper and similar products and further describes new classes of chemical materials suitable for sizing these products. The method and the new sizing compositions are particularly well suited for sizing in the pH range between about 6.5 and 10.5.

Sizes are used in virtually all finished paper products their primary purpose is to reduce the rate at which the paper sorbs moisture. Sizings fall into two categories: internal fiber treatments and surface treatment of papers. Internal sizes are added to the papermaking stock at some point before the fibers are formed into a web on the paper machine. In surface treatment, sizes are applied as a coating at some point in the dryer section of the paper machine. Sizes for surface treatment are composed of a great variety of natural materials, synthetic resins and mixtures of the two types of materials. They are important to impart liquid holdout in such applications as milk cartons or meat wrappings where the paper is in actual contact with liquids and must prevent their transmission for extended periods of time. They are also used on coated papers to give ink holdout and prevent blurring of printed material. Most papers which are surface treated are also internally sized. This enhances holdout and increases the resistance of the web to the penetration of water while the surface size is applied at the size press in order to minimize sheet breaks.

For several hundred years ink holdout was the only consideration which necessitated sizing papers. Animal derived gelatins and perhaps a few naturally derived gum materials served very successfully when most papers were hand made. With the advent of paper machines which increased the production rate by orders of magnitude, other materials had to be found. Rosin emulsion and soaps, precipitated by alum, came into use about 1830 and have been so successful that they are still the predominantly used internal sizing material. Despite a spectrum of other sizing compositions found in the patent literature, only two besides those based on rosins have achieved even limited commercial success. These are alkyl substituted ketene dimers and alkenyl substituted succinic anhydride. These latter materials are much more expensive than rosin but may successfully be used in the pH range between 6 and 8. Because of its chemical nature, rosin is not generally considered to be an effective sizing material above about pH 6.5 and the great bulk of it is used in the pH range of 4.5 to 5.5.

There are both advantages and disadvantages to forming papers under acidic conditions. One advantage is slightly faster drainage on the wire section of the paper machine. The disadvantages are numerous. Equipment corrosion is one. The relatively short life of paper products made with acidic sizing is another. Deterioration of the paper made under acidic conditions is causing millions of books and other documents to slowly turn to dust before the eyes of their owners. Libraries are spending extensive sums to neutralize the acidity in their books. But due to the expanse and time involved, only the most valuable volumes made from acidic paper can be treated.

In addition to the problems caused by corrosion and paper deterioration, there are other reasons why sheeting at neutral to slightly alkaline conditions is desirable. The papermaker has more choice to choose component materials and may use fillers such as calcium carbonate which are not compatible with acidic systems. However, the expense and difficulty of use of ketene dimer and succinic anhydride based products has greatly limited their use and the time is ripe for new products or techniques.

Conventional sizing theory has been predominantly developed around rosin. Traditional belief holds that sizing occurs when an ambipathic material such as rosin is distributed as uniformly as possible on the fibers with a material such as alum. It is implicit that the sizing material must be oriented with the hydrophobic "tail" outward. It has been assumed that the alum in the system forms a bridge between anionic carboxyl groups of the rosin and the anionic cellulose fibers. When heated in the dryer section of the paper machine, the rosin, under the influence of heat, is presumed to "flow" over the fibers to ensure thorough and uniform distribution. During the application of heat it is assumed that an aluminum ester of rosin is formed that serves to orient the rosin on the fiber with the hydrophobic tail outward.

It may be noted at this point that rosin size is normally available in one of two forms: as an emulsion where the rosin is in the form of rosin acid (acid size) or in solution as the sodium soap (neutral size). Normally both of these forms of size are chemically modified. Typically they will be reacted with formaldehyde to decrease the tendency of the rosin to crystallize and often they are reacted with either fumaric acid or maleic anhydride to improve their efficiency. In neutral sizes from 80–100% of the rosin is in saponified form. Only about 5% of the rosin is saponified in acid sizes. This small amount is sufficient to enable formation of a self-stabilized emulsion without significant need for other emulsifying agents. When neutral rosin soap is used as the sizing agent, it must be well distributed through the system before alum is added. With sizes of this type, it is believed that sizing predominantly occurs at the wet end of the machine with little further development of sizing during drying. In the case of rosin acid sizes, uniform wet end distribution is essential, but sizing continues to develop as the paper passes through the dryer section. Marton and Marton, *Proceedings,* Tappi Papermakers Conference, pp. 15–24 (1982) present a useful discussion of the difference between rosin acid and rosin soap sizes and the presumed mechanism by which they contribute to sizing.

The exact physical chemical mechanism by which sizing molecules bond to cellulosic fibers has been the subject of much debate and there is not a general consensus among experts. The mechanism explained earlier for rosin soap sizes has been fairly generally accepted. Controversy still exists as to the mechanism by which rosin acids, alkyl ketene dimers and alkenylsuccinic anhydride impart sizing. The manufacturers of these sizes generally support the idea of chemical reaction with the cellulose to form covalent bonds. Others insist that this is unlikely and that other attachment mechanisms prevail. An unpublished M.A. Thesis by Lund (University of Washington, Seattle, 1983) gives convincing evidence that alkyl ketene dimer sizes do not react with the fiber to form covalent bonds. These latter two materials differ in one important respect. Alkenylsuccinic anhydride materials develop sizing at the wet end of the machine and little change occurs through the dryer section. Contrary to this, alkyl ketene dimers continue to develop sizing as the paper is heated in the dryer section.

The question of what actually occurs during sizing appears to be even more complex as the process is carried out in near neutral to slightly alkaline environments in the range between pH 6 and 8. Here it is common to add small amounts of polycationic materials to the system. Cationic starch is one such material and polycationic materials normally used as wet strength resins are another. Among the latter group are polyalkylene polyamine epichlorohydrin compositions and cationic ureaformaldehyde condensation products. These are normally added with the size or subsequent to the addition of the sizing material although practice in this regard is not uniform. It is known that these materials help in some way, but the most generally held belief is that they serve to break the sizing emulsion and contribute a slightly cationic charge to the sizing particles so that they will be attracted to and attach to the anionic cellulose fiber surfaces. Various writers refer to these cationic materials, as well as to alum, as fortifying agents, retention agents, or fixatives.

The patent literature on sizing agents is extensive. Despite the many new compositions that have been described, only the three discussed earlier have achieved significant commercial importance. However, the patent literature is informative as to various materials which have been proposed as sizing and the manner in which these materials are presumed to operate. As one example, British Pat. No. 1,255,829 describes a rosin acid size having 80–98% free acid. This material is used with up to 0.5% alum based on fiber with up to 0.25%, based on fiber, of a water soluble cationic polyamide having a molecular weight in excess of 1,000. This system is said to be usable in the pH range of 6–7.5, unusually high for a rosin based size. The reason the system works at this high pH is that the size is added and precipitated before it can be fully neutralized. The additives can be introduced in any order, either with the size, before the size or after the size. Preferred practice would be to add the cationic material after the size and alum have been introduced into the system.

A technical leaflet by the firm BASF, Charlotte, N.C. describes fixing agent FP as a cationic synthetic resin particularly suitable for fixing rosin size in neutral media. This material, believed to be a polyethyleneimine-type, is added to the paper stock prior to the addition of size and alum.

Kulick, U.S. Pat. No. 3,526,524 describes a rosin paste size which includes a water soluble cationic polyalkylenepolyamine. The cationic material is stated to increase the effectiveness of the rosin.

In Canadian Pat. No. 1,008,609, Strazdins teaches that a polyvinylcycloamidine can be used to increase the effectiveness of a conventional rosin-based size. The polymeric material, alum, and size can be added to a pulp slurry in any order or premixed except that the alum and size must be added separately to avoid premature precipitation.

Harding et al, U.S. Pat. No. 4,505,775, teach a process for preparation of cellulosic fibers made cationic by reaction with a modified epichlorohydrin-dimethylamine reaction product. These fibers are said to have less tendency to repel anionic additives and to make possible the use of sizes such as alkyl ketene dimers under less acidic conditions.

Kowatani et al, U.S. Pat. No. 4,576,680, describe new sizes based on alkenylsuccinic anhydride. These inventors note that polyamide polyamine resins are useful as sizing "fixing agents." The inventors are somewhat unclear as to how these materials are used, but they are apparently added to the pulp slurry prior to the addition of the sizing material.

Japanese Kokai 53[1978]-45403 teaches sizing agents based on hydrocarbon O-(substituted carbonyl) oxime derivatives. Polyethyleneimine can be used both as an emulsifier and may be added to the pulp slurry subsequent to the addition of the sizing. These sizes presumably work by an acyl transfer mechanism to attach a long chain hydrophobic portion of the molecule to the cellulose hydroxyl groups.

Beck, U.S. Pat. No. 3,900,335, discloses N,N'-alkyl substituted aspartimide sizing compositions. Common wet end additives such as polyacrylamides and alum may be used with the sizing material. No order of addition of these adjuncts is specified.

In U.S. Pat. No. 3,993,640, Pickard et al describe cyclic N-substituted imide sizing agents in which the N-substituted group is preferably an electron withdrawing group; e.g., a long chain acyl group. The composition presumably imparts sizing by an acyl transfer mechanism to attach the long chain acyl group to the cellulose. Aqueous emulsions of the sizing agents preferably contain a retention aid such as a polyacrylamide. A goal of the invention is to provide a size which is chemically tied to the cellulose by covalent bonding.

In U.S. Pat. No. 3,726,822, von Bonin et al. disclose anionic paper sizes based on succinimide-type compounds mixed with polymeric latices. A retention aid such as a condensate of dicyandiamide and formaledhyde is added to the pulp slurry prior to adding the size. This material may also be applied as a surface size to an alum treated paper.

Bowman and Cuculo, *Textile Res. J.*, 45:766–722 (1975), in discussing the reaction of phthalamic acid with cellulose, note that the phthalimide is formed in a competing reaction which lowers the efficiency of the esterification. These compounds are analogs of succinic anhydride sizes. The above observation would speak against the usefulness of cyclic imide compounds as sizing agents.

The documents cited above are intended to be exemplary rather that fully inclusive of the literature on various sizing materials. The sizing materials described in them are primarily types designed for use in the neutral range and with which a polycationic materials is employed or recommended as a sizing adjunct. It is worthy of note that there is no unanimity of opinion as to when or where the adjacent should be added. Different inventors make different recommendations even though the sizing materials may be chemically similar.

What has been lacking in the field of paper sizing is a full and clear understanding of the mechanism by which sizing compounds are transferred to and retained by the fiber and the mechanism by which sizing further develops in the dryer section of the paper machine. The present inventors now believe they have discovered and understand these mechanisms. This knowledge has, in turn, led to a definition of chemical criteria for sizing compositions, especially those to be used in the near neutral and alkaline ranges. Of equal importance, the knowledge of how sizing is transferred and developed has led to new process criteria which are generally applicable to a wide spectrum of heretofore unsuspected and undescribed paper sizing compositions.

SUMMARY OF THE INVENTION

The present invention is a method of sizing a cellulosic paper product and in particular products made under neutral to alkaline conditions. The invention further discloses entire new classes of chemical materials which give excellent sizing. The method of the invention has arisen out of new insights as to how sizing occurs in paper products and how sizing is transferred from the liquid phase of a papermaking slurry to the cellulose fibers comprising the ultimate product. Out of this knowledge has arisen the further understanding of the molecular architecture required for chemicals useful for sizing paper. Many of these new sizing compositions are effective at least as high as pH 10.5 when used with the methods of the present invention whereas conventional sizing technology and materials are ineffective above the range of pH 8–8.5.

As noted in the background of the invention, conventional wisdom holds that either the sizing chemical, which has been added to the papermaking stock as an emulsion, or the fiber surface, or both, must in some way have the ionic charge on their surface adjusted so that they are compatible and attractive to each other. With rosin sizes, alum is the single chemical most used to accomplish this modification. It serves the further purpose of breaking the emulsion and, under acidic conditions, causing the formation of minute rosin acid globules. These are ionically attracted to or in some other way contact the cellulose fibers. Here they are held in an aluminum complex of some type which may include aluminum esters. When rosin sizes are used under conditions which approximate neutrality, additional adjuvants are often added to the system. There is no consistency in practice or understanding as to when or where these materials should be included or even as to the function they perform.

It is also known that paper treated under relatively strongly acidic conditions with soap sizes and alum; i.e., about pH 4.5, has developed sizing by the time it leaves the wet end of the paper machine. Little further development occurs during the dryer section. On the other hand, it has further been observed that in paper sized under conditions when significant amounts of rosin acid are present, sizing develops as it passes over the dryers. This development has been attributed to the rosin acid physically "flowing" over the fibers under the influence of heat.

The above beliefs fail to explain many of the phenomena associated with sizing. For example, it is known that under some conditions there is decrease in sizing as one goes from the surface to the interior of a large roll of kraft linerboard. It has been further observed that satisfactorily sized sheets can be made of stock which is a mixture of previously sized with unsize fibers. It has also been observed that sizing regression occurs in some products; i.e., sizing decreases even at room temperature over time. Because of the above and other problems, it was felt that the currently accepted theories of sizing were too limited and lacked the scientific elegance to explain the above-noted discrepancies and many others. It was apparent that a modification of the currently accepted theory was needed to give a broad understanding of the overall mechanism by which sizing occurs in paper.

As the work developed, it appeared that previous workers had not understood that there were at least two separate processes involved in the development of sizing. They had assumed that materials which brought size down onto the fiber should also hold in on the fiber. Present work has shown that these concepts must be considered separately. This understanding has now evolved into what we will term the Strong Bond/Weak Bond theory. When size has been brought down onto the fibers from the papermaking slurry to a receptive fiber surface, the size begins to react in one of two ways to produce what is called for convenience either a "strongly bonded" or "weakly bonded" entity.

A strongly bonded entity is defined here as one where the bond between a cellulose fiber and a sizing chemical cannot be readily broken by energy available in the dryer section of a paper machine. This could include covalent bonds, aluminum esters, and ionic bonds of unit or greater charge.

A weakly bonded entity is here defined as one where the bond between a cellulose fiber and sizing chemical can be broken by the energy availabe in the dryer section of a paper machine. This, in turn, can include such bonds as certain electrostatic bonds of less than unit charge and van der Waals linkages.

In strong bond sizing the distribution of the sizing on the fiber will normally occur and be fixed prior to the time the fiber slurry flows onto the sheet former. Contrary to this, in a weak bond system, the distribution of the sizing chemical through the sheet can largely occur during drying.

Our data strongly support the earlier cited observations of Lund and others he cites that this distribution occurs by the vapor phase redistribution of the chemical rather than by a physical "flow" or sintering process as had been previously believed. This indicates that the chemical imparting the sizing to the fibers must have a positive vapor pressure of some minimum magnitude at the pH at which the paper is being manufactured if it is to ultimately be uniformly distributed through the fiber mass. The vapor pressure of the sizing material should be at least $1\times10^{-4}$mm of mercury at dryer section temperatures of about 60° C. Preferably the vapor pressure will be at least $6\times10^{-4}$mm at 60° C.

It is implicit to the development of sizing that the sizing molecule must be oriented with the hydrophobic "tail" outward. This need for a proper orientation mechanism has been little considered. In many systems inversion of the orientation of the size molecule will occur. This places the hydrophobic tail near the fiber and the hydrophilic polar group facing away from the fiber with a subsequent loss of sizing. With proper orientation of the sizing molecules on the fiber surface, the hydrophobe/hydrophile ratio of the polar and nonpolar moieties comprising the the sizing molecule determines the ultimate hydrophobicity that can be given to that fiber. However, there also appears to be an optimum ratio of the hydrophobic to the hydrophilic moieties. When deviations from this ratio are too large, sizing will suffer. We have found that the hydrophobic portion should be a hydrocarbon or substituted hydrocarbon group with a total of at least 8 carbon atoms if the hydrophilic portion does not contain a ring structure and at least 6 carbon atoms if the hydrophilic portion of the molecule is associated with a ring structure. The hydrophilic portion in either case may have up to 40 carbon atoms but it preferably has between and 20 and most preferably between 12 and 20 carbon atoms.

A critically important aspect of sizing that has been readily overlooked before is the need for preparing a receptive fiber surface. This is a problem which can be considered and dealt with entirely separate from the matter of bringing the sizing onto the fiber surfaces. Experiments have shown that if the fiber surface is first made mildly cationic by treating it with either water soluble or water dispersible polyvalent metal ions or polycationic polymers, or some combination of these, the bond strength between the fiber and sizing can be controlled so that a desirable balance is achieved between strong bonds and weak bonds. We refer to the material used in this first treatment as a "catcher" or an "anchoring/orienting" agent. What is even more important, the anchoring/orienting agent can be chosen for the specific chemistry of the sizing materials so that sizing will be fully developed by dryer heat by the time the sheet reaches thesize press on the machine.

The question might be asked why are not strong bonds achieved at the wet end the most desirable. The answer to this is found in the dimensions of the size globules striking the fibers. If this occurred at a molecular level where the fibers would be completely coated with a monolayer of closely adjacent sizing molecules, there would be no need for subsequent sizing redistribution. However, this ideal situation is seldom approximated in practice. The sizing comes to the fiber as finite globules which attach to the fiber with significant space between adjacent globules. Unless the sizing chemical is somehow enabled to move into this space between the globules, and of equal importances, be retained by the fiber, good sizing is not possible. Stated simply, there may well be enough sizing present to adequately coat the fibers, but much of it is not located at the right places. If good sizing at high efficiency is to be developed, the two requirements stated above may be restated as essential criteria: (1) the size must be enabled to move unsized areas of the fiber surface, and (2) the unsized surface must be adequately receptive so that the sizing will be anchored and have the proper orientation. It is this last criterion which has been almost completely ignored by past workers in the field.

It has now become apparent why it is so difficult to achieve good sizing with rosin at a pH above about 6.5. The lower the pK of an acid, the more that material will be ionized at a given pH. Rosin fumarate has a measured pK of approximately 5.3 in water. The use of the Henderson-Hasselbach equation enables one to predict the pH at which a given ratio of anion to anion conjugate acid can exist. This equation is as follows:

$$pH = PK' + \log(\text{Anion}/\text{Anion H})$$

Using this equation, it is apparent that at pH 6.5, 94% of the acidic groups in rosin fumarate are saponified and in soap form at equilibrium and little acid form remains available for distribution. At pH 8.5 the acidic groups are 99.94% saponified at equilibrium. The salts of fatty acids for practical purposes have no volatility at all under dryer conditions. As noted previously, the evidence strongly points to a vapor phase redistribution of the sizing. Thus, at a pH above 6.5, when the rosin is largely in the soap form, little is available to move to unsized areas of the fiber. Unless the fiber surface is receptive, even that very small portion which remains unionized and in free acid form may simply disappear from the system instead of being captured by areas which lack sizing. It follows from what has just been stated that the higher the pK of the sizing compound the more will remain un-ionized at higher pH. This then leads to one of the criteria of the present invention. If a size is to be used under neutral to alkaline conditions, the pK should be 6 or greater. The range of pK may fall between about 6 and 14 in water, or even somewhat higher in some instances. Preferably, the pK of the sizing composition will be in the range between about 6 and 12 in water and most preferably in the range of about 9–10. Carboxylic acid types sizes, such as rosin, or materials which produce carboxylic species as the effective sizing agent, do not generally meet the pK requirement of the present invention.

A second criterion for the sizing material is directed to its molecular geometry. Extremely strong bonds, such as covalent bonds or bonds formed through aluminum esters, effectively prevent any redistribution of the sizing material. At the other end of the scale, extremely weak bonds, such as those given by van der Waals' forces, hold the sizing so loosely that much of it may be lost. The present invention is based on an alternative explanation of bonding between the sizing molecule and fiber. This has led to a new and more efficient method of applying sizing. It has also opened the door for many new and unexpected chemical materials to be used as sizes. It now appears that when the sizing molecule is tied to receptive sites on the fiber by coulombic forces the bond strength may be controlled by the chemistry of both the sizing molecule and the anchoring/ orienting agent used to bind it to the fiber. Coulombic forces are electrostatic forces created by adjacent oppositely charged molecules or, stated otherwise, molecules having opposite electrical polarity. To achieve this coulombic binding, the sizing molecule should hve a hydrophilic portion which provides a The word "bidentate" is used herein in an analogous manner to the way in which it is applied in the chemistry of polyvalent and transition metals which can form five or six membered rings with certain organic molecules having at least two hetero atoms. It is not implied here that such complexes are even involved in the current invention. However, the adoption of an analogous bidentate criterion, taken in conjunction with the pK criterion stated earlier, has proved to be powerfully predictive of new compounds which form highly effective sizing materials.

Another criterion of the sizing chemical is adequate volatility to redistribute over the fibers under conditions encountered in the paper machine dryer section. The vapor pressure should be at least $1\times10^{-4}$mm of mercury at dryer section temperatures, typically about 60° C. Preferably it is at least $6\times10^{-4}$mm of mercury at 60° C. and may be much higher. Salts and other compounds which are tightly ionically bonded normally fail to have a vapor pressure in the above range.

The sizing chemicals of the present invention are of form $R_1$—B—C—D wherein $R_1$ is selected from nonpolar straight chain or branched alkyl, alkenyl, substituted alkyl, substituted alkenyl groups containing from 6–40 carbon atoms, and nitrophenyldiazo, wherein said substituent groups are selected from the group consisting of halogen, phenyl, alkylphenyl, halophenyl, alkoxyphenyl; B is absent from the sizing molecule or is a small polar moiety selected from the group consisting of carboxyl ester (—COO—), carbonyl, oxygen, sulfur, and —$NR_2$—where $R_2$ is hydrogen or methyl; C is absent from the sizing molecule or is selected from aryl, alkylene, and cycloalkylene groups wherein the latter two groups may have from 1 to 6 carbon atoms; and D is a bidentate polar group possessing an acidic proton and having a pK >6 in water and is selected from the group consisting of o-dihydroxyaryls, hydroxamic acids, betadiones, amides and cyclic imides.

In addition to the compounds just stated, the following materials, while not actually tried, would be predicted to form satisfactory sizing agents: 2-hydroxypyridines, 2-hydroxyquinolines, 8-hydroxyquinolines, sulfonamides, N-monoalkyl sulfonamides, N-monoaryl sulfonamides, oximes wherein the oxime group is vicinal to other heteroatoms, nitrolic acids, C-alkylsuccinicdiamides, C-alkylmalonicdiamides, N-oxo-2-hydroxypyridines, N-oxo-2-hydroxyquinolines, nitroalkyls with alpha hydrogen, 5-alkylthiazolidine-2,4-diones, 5-arylthiazolodine-2,4-diones, 5-alkylidene-2-thioxothiazolidine-4-one, 5-arylidene-2-thioxothiazolidine-4-one, 3-alkyl-1,2,4-thiadiazole-5(2H)-one, 3-aryl-1,2,4-thiadiazole-5(2H)-one, 5 or 6-alkyl-2-thiouracil, 5 or 6-aryl-2-thiouriacil, and 2,2-dialkyl-6,6,7,7,8,8-heptafluoro-3,5-octanediones.

Materials suitable for anchoring and orienting agents may be drawn from the wide variety of commercially available water soluble or water dispersible polycationic polymers. These are chosen from crosslinked or uncrosslinked polymeric reaction products of epichlorohydrin with a material selected from the group of aliphatic amines of the form $R_4$—NH—$R_5$, tertiary aliphatic diamines of the form $$R_6N-R_8-N-R_{10}$$

aliphatic diamides of the form $$H_2N-\overset{\overset{\displaystyle O}{\|}}{C}-R_{11}-\overset{\overset{\displaystyle O}{\|}}{C}-NH_2,$$

and mixtures thereof, wherein the crosslinking agent if present is selected from ammonia, primary aliphatic amines containing up to 8 carbon atoms, polyalkylene polyamines, and mixtures thereof, with $R_4$ and $R_5$ being alkyl groups totaling not more than 8 carbon atoms, $R_6$, $R_7$, $R_9$, and $R_{10}$ being methyl or ethyl groups, $R_8$ being an alkylene group having between 2 and 8 carbon atoms, and $R_{11}$ being an alkylene group having between 0 and 8 carbon atoms. Also useful are partially or wholly quaternized polyethylene-imines where the quaternary substituents are methyl or ethyl groups or are polyethyleneimine branches at tertiary nitrogen atoms. Especially useful among these are amine and polyamine reaction products with epichlorohydrin in both crosslinked and uncrosslinked form. Polymers which are polyamide-polyamine-epichlorohydrin reaction products are also generally suitable. One preferred anchoring and orienting agent is selected from crosslinked and uncrosslinked condensates of epichlorohydrin and dimethylamine wherein the crosslinking agent, if present, is selected from ammonia and a primary aliphatic diamine of the type $H_2N$—$R_3$—$NH_2$ where $R_3$ is an alkylene radical of from 2–8 carbon atoms. Polycationic metal salts, such as alum or Zr(IV), are also useful anchoring and orienting agents under some circumstances. Polyvalent metal salts may be employed in conjunction with a polycationic polymer as a means for increasing the bond strength between the anchoring agent and the size when the pK of the sizing material is quite high or the more polar form of the sizing agent is more slowly developed; e.g., by keto-enol tautomerism.

The usage of anchoring and orienting chemicals will vary depending on their nature and the type of sizing material used with them. This will generally be in the range of 0.5–10 kg/t d ry weight based on fiber. Many of the anchoring materials are supplied as solutions in water having about 50% solids. The exact solids content is often difficult to measure without causing decomposition. Preferred usage of those supplied in this manner is in the range of 2.5–5 kg/t on an as-received basis. Where alum is used as an adjuvant to the anchoring material, it will rarely be used in amounts as high as 10 kg/t. Preferred usage, if alum is used at all, is in the neighborhood of 2.5 kg/t. Optimum usages can be readily determined experimentally. Alum as used conventionally in paper sizing is rarely ever used in amounts less than 10 kg/t and frequently higher amounts are used.

The final component of the present invention is a precipitant added to the pulp suspension after the anchoring agent and after the sizing materials have been dispersed in the slurry. The precipitant should be used in the minimum amount necessary to break the sizing emulsion. The chief purpose of the precipitant is to break the emulsion and precipitate the sizing agent into the fibers, not to form attachment points for the globules on the fiber. The latter function is served by the anchoring/orienting agent. It is conceivable that under some circumstances the same material could be used as an anchoring/orienting agent and as a precipitant. However, it is inherent in the present invention that these would be added to the pulp slurry at different times, the anchoring agent before and the precipitant following the addition and dispersion of the sizing agent. Small quantities of alum are normally preferred as the precipitant. Usually, no more alum should be added at this point than is necessary to break the sizing emulsion. It is important to avoid the formation of of excess quantities of a strong bond complex that restricts redistribution of the size in the dryer section.

It is greatly preferred that sizing using the precedure of the present invention should be carried out at a system pH of at least 5.5 or higher, measured after addition of the emulsified size and precipitant.

The present inventors are unaware of any distinction made in the literature between the anchoring/orienting function and the precipitating function. While, as just noted, the same chemical entity may sometimes fill both roles, it will be frequently be too low or too high in efficiency in performing one of the functions. As an example, polycationic polymers frequently serve with low efficiency as precipitants whereas good precipitants such as alum, especially when used in excess, sometimes bind the initially precipitated size globules so tightly to the fiber that the material cannot redistribute on heating. The function of the precipitant is to bring the minute globules of size down onto the fiber. The function of the anchoring agent is to hold the sizing and assist in redistribution and orientation of the excess sizing molecules in the globules. The anchoring agent also controls the rate of redistribution and consequent increase in sizing. For most economic and efficient sizing the extent and rate of redistribution should be controlled by the anchoring/orienting material and not by the precipitant.

DESCRIPTION OF THE PREFERRED EMBODIMENTS

A number of candidate chemicals from different chemical genera were arbitrarily selected to be tested as paper sizing agents using the procedures of the present method. With the exception of one group, these materials all met the criteria of having a bidentate hydrophilic portion with hydrophobic substituent groups and a pK in water greater than 6. All of the chemicals were evaluated in laboratory prepared handsheets.

GENERAL PROCEDURE FOR MAKING AND TESTING HANDSHEETS

Handsheets were made using a bleached mixed conifer, predominantly inland spruce, kraft pulp using standard Tappi procedures with a 15.2 cm (6 inch) diameter British sheet mold. Sheets were made at one of two basis weights as specified in the examples. Either 1.88 g or 2.50 g (dry weight) of the pulp was suspended in water at 0.5 to 1.0% consistency and dispersed for 2 minutes at high speed in a Waring Blendor. These pulp usages correspond to sheets having grammages of about 100 and 140 g/m$^2$.

Those handsheets made according to the present invention were prepared by first adding the specified amount of the cationic size anchoring and orienting agent (the catcher) in an aqueous solution to the dispersed pulp furnish in the blender. This mixture was blended 30 seconds to permit the material to alter the electrical charge on the pulp fiber surface. Then the sizing agent was added. In some cases the size was prepared as an emulsion but more frequently it was used as a solution in alcohol or acetone, if a solid, or undiluted ("neat"), if the material was a liquid. While this procedure would not be preferred for production use it served well for screening new compositions.

After size addition the pulp slurry was blended for an additional 60 seconds. Finally, a solution of the size precipitant, typically papermaker's alum, was added and dispersed for 30 seconds. The pH was adjusted as required with dilute sodium hydroxide solution or sulfuric acid and then the slurry was sheeted. Sheets were couched and then either air dried at 50% R.H. or on a drum dryer at 105° C. as specified.

Sizing was measured using a modified Hercules Size Test procedure. (Hercules, Inc., Wilmington, Del., Bulletin PM 515). No lactic or formic acid were used in the wetting liquid. The sheet being tested was placed over a photocell and reflectance from the back of the sheet adjusted to 100%. A green anionic dye solution in water was added to the reservoir on top of the sheet. The time in seconds was measured for the dye solution to penetrate and decrease the reflectance to 80%. Tests were arbitrarily terminated at 600 seconds (sometimes 300 seconds) if dye penetration had not occurred prior to this time or when reflectance had dropped to 80%, whichever occurred first. Commercially made sized papers typically reach 80% reflectance in 15–50 seconds.

SIZING TRANSFER EXPERIMENTS

Heavily sized handsheets (150 kg/t of the sizing agent) were prepared. Receiving sheets were made of the same bleached spruce kraft pulp to a basis weight of 90–95 g/m$^2$. These were treated only with 2.5 kg/t of a cationic size anchoring and orienting agent and then the slurry was adjusted to the desired pH. For all experiments reported here either alum or Nalco 7135, believed to be a hexamethylenediamine modified epichlorohydrin-dimethylamine condensation product was used as the anchoring/orienting agent. Nalco 7135 is available from Nalco Chemical Company, Oak Brook, Ill. Five of the unsized receiving sheets were placed over the heavily sized donor sheet. This sheet bundle was wrapped in aluminum foil and placed on a hot plate at 110° C. with the sized sheet adjacent to the hot surface. A weight is placed on top of the stack to keep the sheets flat and in contact. The sheet bundles were heated for varying times and temperatures as indicated in the examples. The receiving sheets were periodically tested for development of sizing.

SYNTHESIS OF CANDIDATE SIZING MATERIALS

The following chemicals were regarded from theoretical considerations as excellent candidate sizing materials representing three classes of bindentate molecules: 4-octanoylcatechol; stearoyl, N-methylstearoyl, and oleylhydroxamic acids; and 2,4-heptadecadione. None of these could be found from commercial sources. Therefore, they were synthesized by the following procedures.

4-Octanoylcatechol was prepared from catechol and octanoyl chloride by the method of Miller et al, *J. Am Chem Soc,* 60:7–10 (1938). The product was distilled and a broad fraction collected which boiled from 200°–220° C. at 2 mm Hg. Attempts to recrystalize the oily material proceeded poorly. The oil was then separated into two fractions on a neutral aluminum oxide column packed in ethyl acetate. Ethyl acetate containing 15% methanol washed off a non-phenolic fraction. Ethyl acetate containing 10% acetic acid then was used to wash off a phenolic fraction. Recrystallization of the latter from hot cyclohexane gave material with m.p. 87°–88° C. $^{13}$C-NMR of the product was consistent with the structure of 4-octanoylcatechol.

The hydroxamic acids were prepared from the corresponding carboxylic esters, the appropriate hydroxylamine hydrochloride, and potassium hydroxide using the method of Hauser and Renfrow, *Organic Synthesis,* Coll. Vol. II, p.67 (1943). Solutions of hydroxylamine HCl or N-methylhydroxylamine HCl in methanol were each combined with solutions of KOH in methanol. The precipitated KCl was filtered off and each solution treated with 0.5 equivalent of methyl stearate in isopropanol or with liquid methyl oleate. The N-methylstearoylhydroxamic acid was recrystallized from toluene and had a m.p. 102°–104° C. The oleoylhydroxamic acid was recrystallized from ethyl acetate and melted at 78°–79° C. Infrared spectra were consistent with a hydroxamic acid structure for each material.

2,4-Heptadecadione was prepared from 1-bromododecane, 2,4-pentanedione, and sodium amide in liquid ammonia using the method of Hampton and Harris, *Organic Synthesis,* Coll. Vol. V, p.848 (1973). The product was extracted into ether, washed with water, dried with magnesium sulfate, and the ether removed. The remaining solid residue was recrystallized from ethanol to give a solid with m.p. 46°–47° C. The $^{13}$C NMR spectrum was consistent with the structure of 2,4-heptadecadione.

SCREENING TESTS

A series of samples was made using a commercially available acid rosin emulsion size. All tests were carried out at pH 6.5, a condition normally regarded as the extreme upper limit for use of a rosin size. Three different polycationic polymers, each at two levels, were used as anchoring/orienting materials. These materials were Nalco 7135, Nalco 7655 and Monsanto SR-31. The Nalco materials are available from Nalco Chemical Company, Oak Brook, Ill. The N-7135 is believed to be a hexamethylenediamine (HMDA) modified epichlorohydrin dimethylamine reaction product. N-7655 is believed to be the unmodified reaction product of epichlorohydrin and dimethylamine.

SR-31 is available from Monsanto Chemical Company, St. Louis, Mo. and is believed to be an amine-epoxy adduct, sold primarily for use as a wet strength agent. All of the handsheets were prepared as described under the general procedure with the anchoring/orienting agent being added first, then the rosin acid size, and finally the alum precipitant. In all cases 2.5 kg/t of the sizing agent was used. The reported usage of cationic polymers was on an as received basis; i.e., containing approximately 50% polymer in water solution. The results of these tests are reported in Table 1. Alum and rosin were added on a 100% solids basis.

TABLE 1

| Polymer Used | Polymer Usage kg/t | Alum Usage kg/t | Sizing, seconds Unheated | Heated |
|---|---|---|---|---|
| N-7135 | 1 | 2.5 | 61 | 600+ |
| N-7135 | 4 | 2.5 | 314 | 600+ |
| SR-31 | 2 | 2.5 | 23 | 278 |
| SR-31 | 4 | 2.5 | 46 | 600+ |
| N-7655 | 1 | 2.5 | 58 | 173 |
| N-7655 | 4 | 2.5 | 1.3 | 1.6 |
| None | — | 10 | 0 | 0.2 |

Referring to the sizing data in Table 1, two results stand out clearly. It is indeed possible to get excellent sizing with rosin at a pH as high as 6.5 using the method of the present invention. This is shown with the samples made at that pH using the Nalco 7135 as an anchoring agent. The seconde thing that stands out are the obvious differences in performance of the various polymers. The N-7135 is presumed to form relatively weak bonds with the sizing permitting ready redistribution on heating. In contrast the N-7655 may form strong bonds with the sizing agent, or size may have been lost from the sheet on heating due to an excessively weak bond between the size and sheet. Relatively little additional sizing developed on heating. This shows the opportunity for tailoring the anchoring/orienting agent to the sizing material, based on their relative polarity. The poor sizing results obtained when no anchoring agent was used are interpreted to indicate that original distribution of sizing on the fibers was non-uniform and/or little or no redistribution occurred under the test conditions used.

Commercially sold rosin sizes are very reliable when used according to manufacturers' recommendations. When these materials were used for screening tests, it can be assumed that failure to give sizing represents a problem in the chemistry of the system. This assumption may *not* by made for the new materials reported here. Emulsification studies to prepare optimally dispersed sizes are very time consuming and are impractical when a large number of chemicals are being screened. For this reason most of the new sizing materials were used unemulsified. In this situation, failure of a material to give sizing must be considered an ambiguous result. It could indicate that the material was ineffective under the conditions used or it could simply be a technical failure to properly precipitate and hold the candidate material on the fiber. Nevertheless, clear patterns developed. Some generic classes of materials repeatedly failed to produce sizing while others consistently produced excellent sizing. In many of the screening tests results with the same sizing compound were either maximum or zero sizing.

Candidate sizing materials were first screened at the very high (and commercially impractical) usage of 150 kg/t, based on dry fiber. Those that showed sizing at this level were then screened at 10 and 2.5 kg/t, the latter being a typical level of commercial usage.

Based on the criteria developed from the Strong Bond/Weak Bond sizing theory presented earlier, representatives of four generic classes of chemical materials expected to be suitable were screened at pH values generally in the 6.5–10.5 range. The three genera from which candidates were drawn were catechols, beta-diketones, hydroxamic acids, and imides. A number of monophenols and non-vicinal diphenols were screened. No members of these classes gave sizing. This led to the conclusion that the bidentate polar structure was essential for proper anchoring and orientation in the higher pH ranges. While it is unlikely that paper would be made at pH 10, trials made at this high pH were indicative of the bond strength between sizing and fiber, and it is presumed that this information can be translated into new classes of sizing materials and sizing agents which exhibit improved efficiency.

Handsheets were tested for sizing development as made after air drying at room temperature and 50% RH, and after being heated to 105°–110° C. for about one hour.

A control series was made using a commercially available rosin acid emulsion size. This was used well above the pH range recommended by the manufacturer. Any poor performance noted here for this material should not be considered as an indication of performance expected when used as recommended at lower pH.

EXAMPLE 1

Handsheets were made using Monsize, a very fine particle rosin acid emulsion size. Monsize is a registered trademark of and is available from Monsanto Corp., St. Louis, Mo. This was used in conjunction with Nalco 7135 as an anchoring/orienting agent and alum as a precipitating agent. Sheets were made at a basis weight of about 140 g/m$^2$. The following sizing results were obtained.

TABLE 2

| Size Load kg/t | Anchor Mat'l. kg/t | Alum kg/t | Sheeting pH | Sizing, sec Unheated | Heated |
|---|---|---|---|---|---|
| 150 | 5 | 10 | 6.0 | 73 | —* |
| 150 | 5 | 10 | 6.8 | 44 | — |
| 150 | 5 | 10 | 8.8 | 0 | — |
| 150 | 5 | 10 | 10.4 | 0 | — |
| 10 | 2.5 | 20 | 6.5 | 600+ | 600+ |
| 10 | 2.5 | 20 | 7.5 | 600+ | 600+ |
| 10 | 2.5 | 20 | 8.5 | 600+ | 118 |
| 2.5 | 5 | 10 | 5.5 | 600+ | — |
| 2.5 | 5 | 10 | 5.5 | 600+ | — |
| 2.5 | 2.5 | 20 | 6.5 | 600+ | 50 |
| 2.5 | 2.5 | 20 | 8.5 | 47 | 0 |
| 2.5 | 2.5 | 20 | 10.5 | 0 | 0 |

*Missing values indicate that the samples were not tested.

The data indicate that, given the use of an anchoring-/orienting agent and sufficient alum in the system, at least some sizing can be obtained with rosin up to pH 8.5 but no sizing was found at pH 10.5. The data further show that when commercial quantities of size were used (i.e., ~2.5 kg/t) in the pH range of 6.8–8.5, the sizing was essentially lost when the samples were heated.

These data are fully in accord with results that would be expected from many years of experience with rosin sizes. They are also in accord with results predicted by the Strong Bond/Weak Bond theory described earlier. The work also illustrates a way to remarkably improve sizing by rosin acid at pH 6.5 using separate anchoring-/orienting agents and precipitant.

EXAMPLE 2

A number of monophenols and non-vicinal dihydroxy phenols were tested. These produced no sizing at all, leading to the requirement for a bidentate structure of the hydrophilic portion of the molecule. Nonylphenol, dinonylphenol, 2-chlorophenol, 4-chlorophenol, 2-hydroxyacetaphenone, salicylaldehyde, 4-dodecylresorcinol, dihydroxyanthraquinone, and 2,2-bis-(4-hydroxyphenyl) butane all failed to produce any sizing under the conditions of testing. Tests were primarily made in the pH 4.5–5.5 range although nonyl and dinonylphenol were tested over the range of 4.5–10.8. Either 5 or 10 kg/t Nalco 7135 was used as an anchoring orienting agent and alum precipitator usage varied between 2.5 and 40 kg/ton, most typically about 10 kg/t.

EXAMPLE 3

A group of catechol-type compounds were tested for sizing efficiency. The term "catechol-type" refers to compounds including an aromatic moiety with two adjacent hydroxyl groups. There may be additional hydroxyl groups present in adjacent or non-adjacent positions. In light of the Strong Bond/Weak Bond theory catechols were predicted to be suitable sizes when properly substituted with a hydrophobic moiety. They meet the bidentate criterion, have the requisite vapor pressure, and generally have a pK falling within the range of 7–10. A number of materials commercially available as laboratory reagents were chosen for testing. One, 4-octanoylcatechol was synthesized in the laboratory using standard published methods as described earlier. The chemicals selected for screening included materials believed to be suitable sizing agents and those expected to be unsuitable due to a low ratio of hydrophobic to hydrophilic portions of the molecule. Results of tests and a list of materials tested is found in Table 3.

In general, those substituted catechols having side moiety substitution totalling at least six carbon atoms contributed excellent sizing. Those with smaller substituent groups, in general, performed poorly or did not size at all. It is significant that good sizing was obtained over the broad pH range of 6.5–10.5. Again, it should be kept in mind that no attempt was made here to optimize either the chemical material or the system in which it was used.

TABLE 3

Catechols Used as Sizing Agents

| Material Used | Sizing Load kg/t | Anchor Mat'l kg/t | Alum kg/t | Sheeting pH | Sizing, sec. Unheated | Sizing, sec. Heated |
|---|---|---|---|---|---|---|
| 4-Octanoylcatechol | 150 | 5 | 10 | 11.3 | —* | 600+ |
| 4-Octanoylcatechol | 10 | 2.5 | 20 | 6.5–8.5 | 600+ | 600+ |
| 4-Octanoylcatechol | 2.5 | 2.5 | 20 | 6.5–8.5 | 600+ | 600+ |
| 4-Octanoylcatechol | 2.5 | 2.5 | 20 | 10.5 | 680 | 490 |
| 4-Octanoylcatechol | 12 | 2.5 | 20 | 5.5 | 300+ | 300+ |
| 3,5-Di-t-butylcatechol | 150 | 5 | 10 | 10.0 | 600+ | |
| 3,5-Di-t-butylcatechol | 2.5 | 5 | 10 | 10.2 | — | — |
| 4-t-Octylcatechol | 150 | 5 | 10 | 10.0 | 600+ | 600+ |
| 4-t-Octylcatechol | 2.5 | 5 | 10 | 10.2 | 83 | 600+ |
| 4-(4 Nitrophenylazo)catechol | 150 | 5 | 10 | 10.8 | 0 | 600+ |
| 4-(4 Nitrophenylazo)catechol | 2.5 | 5 | 10 | 11.0 | 0 | 0 |
| Tetrabromocatechol | 150 | 5 | 10 | 10.2 | 0 | 0 |
| Lauryl gallate | 150 | 5 | 10 | 11.0 | 600+ | 600+ |
| Lauryl gallate | 2.5 | 5 | 10 | 10.2–10.7 | 0 | 0 |
| Octyl gallate | 150 | 5 | 10 | 10.5 | 600+ | 250 |
| Octyl gallate | 2.5 | 5 | 10 | 10.8 | 600+ | 300+ |
| Methyl gallate | 150 | 5 | 10 | 11.0 | 0 | 53 |
| 2,3,4-Trihydroxybenzophenone | 150 | 5 | 10 | 11.0 | 0 | 53 |
| 2,3,4-Trihydroxybenzophenone | 2.5 | 5 | 10 | 10.2 | 600+ | 4 |
| 4-Chlorocatechol | 5 | 10 | 2.5 | 6.9 | 0 | — |
| Methyl-3,4,5-trihydroxy-benzoate | 150 | 5 | 10 | 10.4 | 0 | 0 |
| Ethyl-3,4-dihydroxy-benzoate | 2.5 | 5 | 10 | 10.0 | 0 | 0 |
| 4-(4-Nitrophenylazo) resorcinol | 150 | 5 | 10 | 9.7 | 0 | 0 |
| (4-Nitrophenylazo) benzenetriol | 150 | 5 | 10 | 10.2 | 0 | 0 |
| R-(−)Isoproterenol-HCl | 150 | 5 | 10 | 10.9 | 0 | 0 |

*Missing values indicate samples were not tested.

EXAMPLE 4

Three hydroxamic (HA) acid materials were synthesized in the laboratory, as described earlier, for sizing screening tests. These compounds were N-methylstearoyl HA, stearoyl HA, and oleyl HA. They were tested similarly to the catechols described in the previous example. Results are reported in Table 4.

All of the materials proved to be effective sizes although results were quite variable. This appears to be an indication of lack of optimization of the system rather than an inherent deficiency in the chemical materials themselves. In particular, the loss of sizing on heating at the lower usages of N-methylstearoyl HA seems to indicate that a stronger anchoring/orienting agent may be required.

TABLE 4

| Hydroxamic Acids as Sizing Agents | | | | | | |
|---|---|---|---|---|---|---|
| Material Used | Sizing Load kg/t | Anchor Mat'l kg/t | Alum kg/t | Sheeting pH | Sizing, sec. Unheated | Sizing, sec. Heated |
| N—Methylstearoyl HA | 150 | 5 | 10 | 6.3–10.5 | — | 600+ |
| N—Methylstearoyl HA | 10 | 2.5 | 20 | 6.5–8.5 | 600+ | 600+ |
| N—Methylstearoyl HA | 10 | 2.5 | 20 | 7.5 | 600+ | — |
| N—Methylstearoyl HA | 10 | 2.5 | 20 | 5.5 | 300+ | 300+ |
| N—Methylstearoyl HA | 7.5 | 2.5 | 20 | 8.5 | 600+ | 2 |
| N—Methylstearoyl HA | 5 | 2.5 | 20 | 8.0 | 400+ | 6 |
| N—Methylstearoyl HA | 2.5 | 2.5 | 20 | 6.5 | 18 | 0 |
| N—Methylstearoyl HA | 2.5 | 2.5 | 20 | 8.5 & 10.5 | 0 | 0 |
| Oleyl HA | 150 | 5 | 10 | 6.5 | — | 171 |
| Oleyl HA | 150 | 5 | 10 | 8.3 | — | 162 |
| Oleyl HA | 150 | 5 | 10 | 10.5 | — | 488 |
| Oleyl HA | 10 | 2.5 | 20 | 6.5 | 0 | — |
| Oleyl HA | 10 | 2.5 | 20 | 7.5 & 8.5 | 11 | — |
| Oleyl HA | 2.5 | 25. | 20 | 6.3–10.5 | — | 600+ |
| Stearoyl HA | 150 | 5 | 10 | 6.3–10.5 | — | 600+ |
| Stearoyl HA | 10 | 2.5 | 20 | 6.5 & 8.5 | 600+ | 0 |
| Stearoyl HA | 10 | 2.5 | 20 | 7.5 | 10 | 0 |
| Stearoyl HA | 2.5 | 2.5 | 20 | 6.5–10.5 | 0 | 0 |
| Stearoyl HA | 12 | 2.5 | 20 | 5.6 | 300+ | 300+ |

EXAMPLE 5

A number of beta-dione sizing candidates were obtained from commercial sources. One, 2,4-heptadicadione was synthesized as described earlier. Screening tests were conducted as described in the two previous examples.

Table 5 shows that sizing was obtained from all of the materials having adequate substitution of hydrophobic moieties. No sizing was noted for three materials having shorter hydrophobic groups. As before, it is evident that systems are not optimum but this would not be expected, nor was it a goal, in the screening tests.

TABLE 5

| Beta-Diones as Sizing Agents | | | | | | |
|---|---|---|---|---|---|---|
| Material Used | Sizing Load kg/t | Anchor Mat'l kg/t | Alum kg/t | Sheeting pH | Sizing, sec. Unheated | Sizing, sec. Heated |
| 2,4-Heptadicadone | 150 | 5 | 10 | 6.5 | — | 108 |
| 2,4-Heptadicadione | 150 | 5 | 10 | 8.4–10.5 | — | 600+ |
| 2,4-Heptadicadione | 14 | 2.5 | 20 | 5.4 | 59 | — |
| 2,4-Heptadicadione | 12 | 2.5 | 20 | 5.7 | 300+ | 300+ |
| 2,4-Heptadicadione | 10 | 2.5 | 20 | 6.5–8.5 | 600+ | 600+ |
| 2,4-Heptadicadione | 2.5 | 2.5 | 20 | 6.5 | 750 | 13 |
| 2,4-Heptadicadione | 2.5 | 2.5 | 20 | 8.5 | 6 | 0 |
| 2,4-Heptadicadione | 2.5 | 2.5 | 20 | 10.5 | 600+ | 0 |
| Dibenzoylmethane | 150 | 5 | 10 | 10.7 | 600+ | 600+ |
| Dibenzoylmethane | 2.5 | 5 | 10 | 10.5 | 0 | 0 |
| 2,2-Dimethyl-6,6,7,7,8,8,8-heptafluoro-3,5ocadiione | 150 | 5 | 10 | 10.0 | 3 | 650+ |
| 2,2-Dimethyl-6,6,7,7,8,8,8-heptafluoro-3,5ocadiione | 2.5 | 5 | 10 | 11.0 | 0 | 0 |
| 2,2,6,6,-Tetramethyl--3,5-heptanedione | 150 | 5 | 10 | 9.5 | 33 | 600+ |
| 2,2,6,6-Tetramethyl--3,5-heptanedione | 150 | 5 | 10 | 10.5 | 119 | 700+ |
| 2,2,6,6-Tetramethyl--3,5-heptanedione | 2.5 | 5 | 10 | 11 | 3 | 0 |
| 2-Acetylcyclohexanone | 150 | 5 | 10 | 10.1 | 0 | 0 |
| 1-Benzoylacetone | 150 | 5 | 10 | 11.1 | 0 | 2 |
| 4,4,4-Trifluoro-1-phenyl--1,3-butanedione | 150 | 5 | 10 | 10.3 | 0 | 0 |

EXAMPLE 6

One of the salient points of the Strong Bond/Weak Bond sizing theory is the recognition of redistribution of initially weakly bonded sizing by heat energy on the dryer section of the paper machine. The test for this effect was described earlier. Essentially, the test poses the question as to whether sizing can move from one location on a fiber (or sheet) to an unsized site made receptive by the presence of a catcher molecule. To test for this effect a heavily sized donor sheet is placed in contact with a stack of unsized sheets treated with an anchoring agent. The assembly is then heated and sizing tests are periodically run on the receptor sheets.

Four materials were tested for sizing transfer: N-methylstearoylhydroxamic acid, stearoylhydroxamic acid, oleoylhydroxamic acid, and Monsize rosin acid emulsion. All donor sheets, including those with the rosin size, were made using 5 kg/t Nalco 7135 anchoring/orienting agent, 150 kg/t sizing agent, and 10 kg/t alum precipitating agent. Receptor sheets all had 2.5 kg/t Nalco 7135 as the only additive. Donor and receptor sheets were made in narrow ranges around pH 6.5, 8.5, and 10.5. All sheets were air dried at room temperature and 50% RH. Receptor sheets were tested for sizing after the sheet packs had been heated 1, 3 and 7 days at 110° C.

In the tests made using N-methylstearoylhydroxamic acid and stearoylhydroxamic acid the donor and all five receptor sheets showed a sizing level of 600+seconds after 1, 3 and 7 days at each of pH 6.5, 8.5 and 10.5. This plainly shows sizing agent migration from the donor sheet and capture by the previously unsized receptor sheets.

Results with oleylhydroxamic acid were somewhat different from the above. Earlier reported screening tests (Table 4) did not show particularly good results with this material. The reasons for this are not known, since on theoretical considerations the material should be an excellent sizing agent. It is suspected that the problem was in the initial distribution of the oleyl HA on the fiber. Reference to Table 6, showing results of the transfer tests, shows that oleyl HA can size quite well. It also shows that the system is pH sensitive. The higher the pH, the tighter the sizing appears to be bound to the donor sheet. This suggests that an anchoring/orienting agent that does not bind the material so tightly to the fiber should be selected.

TABLE 6

Oleylhydroxamic Acid Transfer Experiments

| Sheet | Sizing Sec. 1 Day | 3 Days | 7 Days |
|---|---|---|---|
| | pH 6.6 | | |
| R5* | 2 | 290 | 600+ |
| R4 | 2 | 600+ | 600+ |
| R3 | 2 | 40 | 600+ |
| R2 | 2 | 600+ | 600+ |
| R1 | 6 | 600+ | 600+ |
| D | 600+ | 341 | 600+ |
| | pH 8.3 | | |
| R5 | 1 | 3 | 9 |
| R4 | 3 | 12 | 33 |
| R3 | 7 | 36 | 115 |
| R2 | 19 | 88 | 84 |
| R1 | 34 | 228 | 600+ |
| D | 600+ | 600+ | 600+ |
| | pH 10.2 | | |
| R5 | 5 | 3 | 6 |
| R4 | 29 | 7 | 28 |
| R3 | 571 | 573 | 55 |
| R2 | 199 | 324 | 151 |
| R1 | 155 | 158 | 166 |
| D | 600+ | 600+ | 600 |

*R indicates a receptor sheet and D the donor sheet

The transfer experiements made with rosin acid size, particularly those made at the higher pH range are supportive of our interpretation of the sizing mechanism. The data are given in Table 7. Above pH 6.5 rosin acid converts principally to rosin soaps. These are hard to bring down and attach to the fiber and essentially lack volatility. Sizing transfer did occur to receptor sheets at pH 6.5 but did not occur to a significant extent at the higher pH values. Sizing of the donor sheets was also poor at higher pH.

TABLE 7

Rosin Acid Transfer Experiments

| Sheet | Sizing Sec. 1 Day | 3 Days | 7 Days |
|---|---|---|---|
| | pH 6.5 | | |
| R5* | 3 | 10 | 600+ |
| R4 | 2 | 77 | 600+ |
| R3 | 15 | 600+ | 600+ |

TABLE 7-continued

Rosin Acid Transfer Experiments

| Sheet | Sizing Sec. 1 Day | 3 Days | 7 Days |
|---|---|---|---|
| R2 | 491 | 600+ | 600+ |
| R1 | 600+ | 600+ | 600+ |
| D | 600+ | 600+ | 333 |
| | pH 8.5 | | |
| R5 | 3 | | |
| R4 | 4 | | |
| R3 | 7 | | |
| R2 | 39 | | |
| R1 | 600 | | |
| D | 37 | | |
| | pH 10.5 | | |
| R5 | 0 | | |
| R4 | 0 | | |
| R3 | 0 | | |
| R2 | 0 | | |
| R1 | 0 | | |
| D | 3 | | |

*R indicates a receptor sheet and D the donor sheet.

EXAMPLE 7

Transfer experiments on samples made with 2,4-heptadecadione were made in similar fashion to those reported in the previous example. Very little sizing was imparted to the receptor sheets. This indicated that either sizing was not being transferred or that a stronger, more aggressive anchor/orienting material was needed in the receptor sheets. We have discovered that as the polarity of the sizing molecule increases and/or the volatility decreases, weaker anchoring agents are needed. The converse of this is also true. Aliphatic beta-diketones are among the least polar materials screened, suggesting that they would need the strongest anchoring agents. To test the assumption, receptor sheets were made containing 5 kg/t alum in addition to the 2.5 kg/t of Nalco 7135 anchoring material. Tests were conducted only on sheets formed at pH 6.5.

Results seen in Table 8 appear to confirm the need for the stronger anchoring/orienting material with excellent sizing being imparted to the receptor sheets after 1 day at 110° C. It is also interesting to note the apparent development of sizing over time in the donor sheet. The relatively low initial value may have been due to poor initial distribution of the sizing material on the fiber.

TABLE 8

2,4-Heptadecadione Transfer Experiments

| Sheet | Sizing Sec. 1 Day | 4 Days | 7 Days |
|---|---|---|---|
| R5[1] | 419 | — | — |
| R4 | 590 | — | — |
| R3 | 600+ | — | — |
| R2 | 600+ | — | — |
| R1 | 0[3] | 1700+ | — |
| D | —[2] | — | 600 |

[1]R indicates a receptor sheet and D the donor sheet.
[2]Initial unheated value was 108 sec.
[3]This value is unexplained and is presumed due to poor initial distribution of the dione on the fiber.

EXAMPLE 8

Despite the comments in the literature that would discourage a skilled investigator from their use as sizing agents, cyclic imides were found to be effective sizing materials when used according to the teachings of the present invention. A commercially available alkenyl succinic anhydride sizing agent was reacted in water with between 1 and 2 equivalents of ammonia under heated conditions. The resulting product was examined by $^{13}C$ NMR spectroscopy and found to contain alkenyl succinimide and diamide and less than 3% of amic acid. The mixed product was screened for sizing effectiveness as described earlier. A commercially available rosin size (Monsize) was used as a control. Results of tests on unheated samples are reported below.

TABLE 9

| Sizing Agent | Sizing Hood kg/t | Anchor kg/t | Alum kg/t | Sheeting pH | Sizing, Sec. |
|---|---|---|---|---|---|
| Rosin | 2.5 | 5 | 10 | 5.5 | 600+ |
| Rosin | 2.5 | 2.5 | 20 | 6.5 | 650+ |
| Rosin | 2.5 | 2.5 | 20 | 8.5 | 47 |
| Rosin | 2.5 | 2.5 | 20 | 10.5 | 0 |
| Imide/Diamide | 300 | 5 | 10 | 8.7 | 940 |
| | 20 | 5 | 10 | 10.5 | 600+ |
| | 5 | 5 | 10 | 10.5 | 600+ |

While both the succinimide and diamide derivations may be contributing to sizing, it is more likely that the alkenyl succinimide is the more effective sizing agent because of its significantly lower pK.

By analogy we would expect alkyl and alkenyl substituted phthalimides and phthalic diamide compounds, and rosin ester malimides, to be effective sizing materials.

Having thus disclosed the best mode known to the inventors of carrying out their invention, it will be readily evident to those skilled in the art that many changes can be made without departing from the spirit of the invention. The invention is considered to be limited only as it is defined by the following claims.

What is claimed is:

1. A method of sizing a cellulosic paper product which comprises:

first adding to a cellulosic fiber slurry an effective amount of a size anchoring and orienting agent, then adding an effective amount of an emulsified organic sizing compound, and finally adding a precipitant to break the sizing emulsion and bring the size onto the fibers, wherein the anchoring and orienting agents are water soluble materials selected form the group consisting of polyvalent metals, polycationic polymers, and mixtures thereof used in an amount up to about 10 kg/t based on fiber, said agents making the pulp fiber surfaces receptive to receiving the sizing material;

the sizing compound molecule has both hydrophobic and hydrophilic portions, the hydrophilic portion being an alkoyl or alkenoyl hydroxamic acid and the hydrophobic portion of the molecule being a hydrocarbon group having at least 8 carbon atoms;

the size precipitating agent is a polycationic metal salt that serves to break any emulsions of the sizing compounds;

the pH of the system after addition of the sizing compound and precipitant being at least 5.5 or higher, and the anchoring and orienting agent is selected to give a bond strength between the sizing material and pulp fibers so that size redistribution is minimized at room temperature but at least some redistribution to any unsized areas of the fibers occurs at temperatures encountered in paper machine dryer sections.

2. The method of claim 1 in which the hydroxamic acid is N-methylstearoylhydroxamic acid.

3. The method of claim 1 in which the hydroxamic acid is stearoylhydroxamic acid.

4. The method of claim 1 in which the hydroxamic acid is oleoylhydroxamic acid.

* * * * *